United States Patent [19]

Butler

[11] 4,084,468

[45] Apr. 18, 1978

[54] ELECTRIC PAGE TURNER

[76] Inventor: Frank M. Butler, 10 Weber Ter., S. Amboy, N.J. 08879

[21] Appl. No.: 706,139

[22] Filed: Jul. 19, 1976

[51] Int. Cl.[2] ..... G10G 7/00

[52] U.S. Cl. ..... 84/500; 84/516

[58] Field of Search ..... 84/486–487, 84/489–490, 492, 495, 497, 500–501, 516–517

[56] References Cited

U.S. PATENT DOCUMENTS

| | | | |
|---|---|---|---|
| 1,034,916 | 8/1912 | Kimbler | 84/497 |
| 1,140,612 | 5/1915 | Retzler et al. | 84/486 X |
| 1,219,904 | 3/1917 | Bailey | 84/492 |
| 1,739,065 | 12/1929 | Ensign | 84/501 |

*Primary Examiner*—Lawrence R. Franklin
*Attorney, Agent, or Firm*—Robert D. Farkas

[57] ABSTRACT

This disclosure pertains to an arm adapted to be installed below a page in a book. The arm is secured to a shaft that is biased to urge the arm in a position which causes the page to be turned. A solenoid coil, operated by a battery and foot switch, releases the shaft allowing the bias means to turn the page. Spring clips carrying a frame are secured to the marginal edges of the book cover. The shaft, spring, and solenoid coil are carried by the frame.

5 Claims, 2 Drawing Figures

ELECTRIC PAGE TURNER

BACKGROUND OF THE INVENTION

1. THE FIELD OF THE INVENTION

This invention relates to automatic page turning devices and more particularly to that class adapted to turn a single page upon the electrical release of a spring operated page turning arm.

2. DESCRIPTION OF THE PRIOR ART

The prior art abounds with apparatus adapted to turn pages in books or musical scores. U.S. Pat. No. 1,038,622 issued on Sept. 17, 1912 to M. J. Ryan teaches a solenoid coil operated arm which utilizes a pin to selectively turn pages in a book upon the electrical energization of the coil.

U.S. Pat. No. 2,526,540 issued on Oct. 17, 1950 to E. V. Carpenter discloses an electrically operated page turner which utilizes a motor and gear box to operate an arm which turn sequential pages in a book.

The aforementioned Patents suffer the common deficiency of excessive cost of manufacture due to the complexity of the operation of the apparatus. Furthermore, the prior art does not provide for a simple means to attach the book, containing the pages to the page turning apparatus. The requirement of turning a multiplicity of pages causes the apparatus required therefor to be cumbersome, costly to manufacture, and difficult to maintain.

SUMMARY OF THE INVENTION

A primary object of the present invention is to provide a page turning apparatus suitable for the manipulation of a single page.

Another object is to provide an inexpensive and lightweight page turning device.

Still another object is to provide a remotely operated page turning device which can be conveniently and readily secured to a book containing a page to be turned thereby.

Yet another object is to provide an apparatus which can be reset in preparation to turning subsequent pages by the simple turning of a knob.

Page turning devices, as disclosed in the prior art, utilize either a single arm adapted to reciprocate back and forth which turns sequential pages in a book or utilizes a plurality of arms interwoven between the leaves of a book and operated sequentially. The present invention recognizes that most sheet music books consist of a composition in which only one page need be turned. A spring biased arm, disposed beneath the page to be turned is released from a biased position utilizing an electromagnet operated from a remotely located pushbutton and battery power supply. Thus, the page can be turned with minimum tension on the part of the musician. The rotation of a single shaft reloads the arm to a position preparatory to turning a page disposed covering it. The operating parts of the present invention are secured to a small, lightweight frame which is in turn fastened to the cover of the book containing, for example, a musical composition, utilizing a pair of spring clips.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a frame having a substantially rectangular shape having at the ends thereof a pair of pincerlike spring biased grasping devices similar in construction to a spring operated paper clipping device. The frame carries a removable cover or housing on the central portions thereof. A shaft is journalled within the housing and extends outwardly from the housing terminating in a knob. An arm, fixedly secured to the shaft and extending radially outwardly therefrom, is contained within the housing. The shaft carries a spring having one end thereof in touching engagement with the arm and the other end thereof secured to a point on the housing such that the spring urges the shaft and arm to rotate in a given direction. A solenoid coil is secured within the housing and is adapted to have its movable core portion engage the free end of the arm in a position in which the spring is disposed in a miximum tensioned condition. When the solenoid is electrically energized, by way of a series circuit including a battery and a momentary operated switch, the actuated movable core portion of the solenoid is urged to reside within the solenoid coil so that the arm is released and is caused to rotate by the bias forces exerted upon it by the spring. The movable core portion of the solenoid is urged towards the shaft by a small spring joined to the frame of the solenoid coil.

A page turning arm is secured to that portion of the shaft that extends outwardly from the housing at a point intermediate the knob and the housing. The page turning arm extends outwardly from the frame and is adapted to be positioned beneath the page to be turned when in a locked position due to the arm touching the movable core portion of the solenoid coil. Upon the solenoid coil becoming energized the page turning arm rotates about the shaft and causes the page to be turned, permitting the page turning arm to be disposed in a released position, residing on the now uppermost surface of the turned page. That portion of the arm contacting the leaves of the book is preferably fabricated from a transparent plastic material so as to permit the user to read the surface of the page when turned. The arm, when released, contacts a soft resilient cushioning pad, fabricated from felt or other similar materials, disposed within the housing on a side of the shaft opposite to the side in which the solenoid coil is located.

Figure 1:
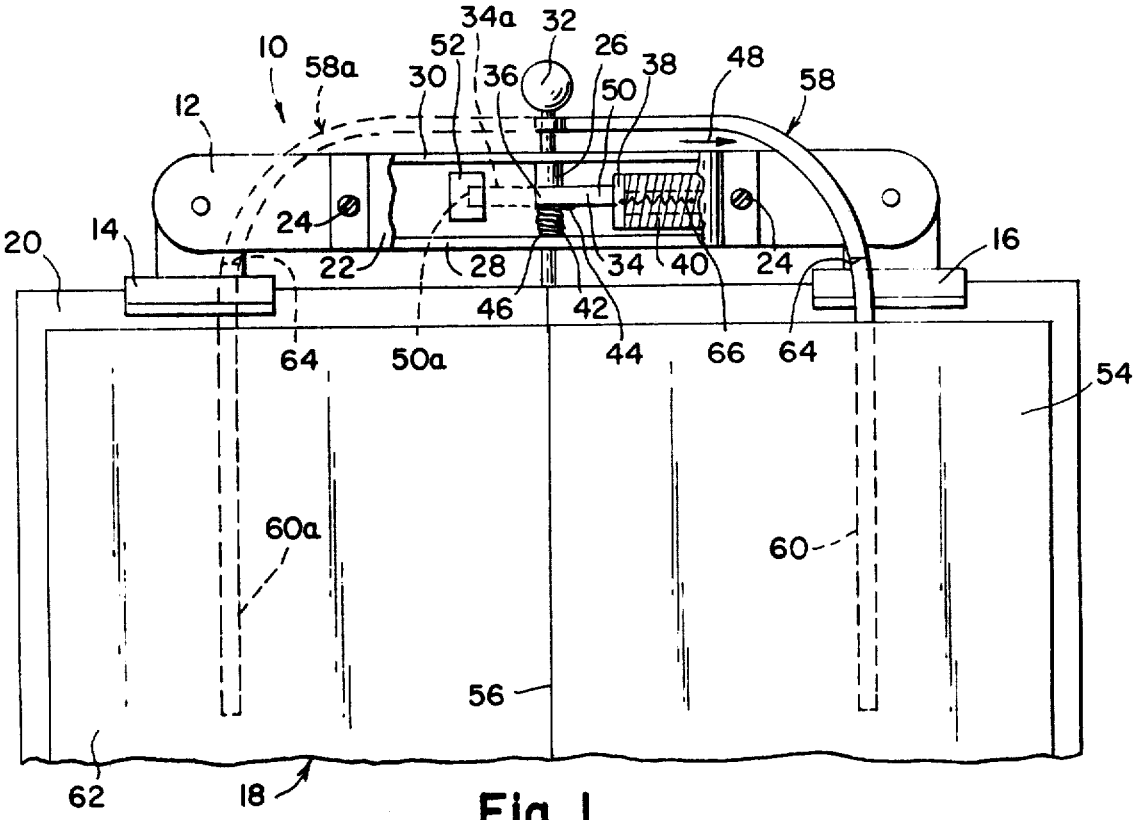
FIG. 1 is a plan view of the present invention attached to a book.

Now referring to the Figures, and more particularly to the embodiment illustrated in FIG. 1 showing the present invention 10 having a frame portion 12 to which is pivotally affixed spring biased grasping devices 14 and 16. Book 18 is adapted with a cover portion 20 grasped by spring biased grasping devices 14 and 16. Housing 22 is secured to frame 12 utilizing screws 24 therefor. Shaft 26 is journaled to walls 28 and 30 of housing 22 and is free to rotate about its longitudinal axis. One end of shaft 26 is terminated in knob 32 disposed outwardly from wall 30. Arm 34 is secured to shaft 26 at end 36 and is shown captured by the moving core portion 38 of electrically operated solenoid coil 40.

Spring 42 is carried by shaft 26 and has end 44 disposed in touching engagement with arm 34. End 46 is secured to wall 28. Spring 42 urges arm 34 into a position depicted by dotted lines 34*a* when moving core 38 is disposed in the direction of arrow 48 releasing end 50 of arm 34. Solenoid coil spring 66 urges moving core 38 in a direction opposite to the direction of arrow 48. End 50 of arm 34 is disposed with a ramped surface, not shown, which allows end 50 to become trapped behind the outermost marginal edge of moving core 38 in similar fashion to the ramped surface of a door latch. End 50*a* of arm 34*a* contacts felt pad 52 when arm 34 is in a released position.

Page 54 is shown residing on the right hand side of centerfold 56 of book 18. One end of page turning arm 58 is secured to shaft 26 intermediate wall 30 and knob 32. Dotted lines 60 indicated that portion of page turning arm 58 that are located beneath page 54 when arm 58 is shown in the locked position caused by end 50 of arm 34 being restrained by moving core element 38. When shaft 26 is permitted to freely rotate about its axis, page turning arm 58 disposes page 54 in a direction opposite to arrow 48, causing the reverse side 62 of page 54 to be disposed in the position shown. Dotted lines 58*a* signify the released position of arm 58 whilst dotted lines 60*a* signify the now exposed portions of arm 58*a* previously hidden by page 54.

Portions 60*a* of arm 58*a* is preferably fabricated from a transparent material such as methyl methacrylate, joined to the remaining portion of arm 58*a* at point 64.

Figure 2:
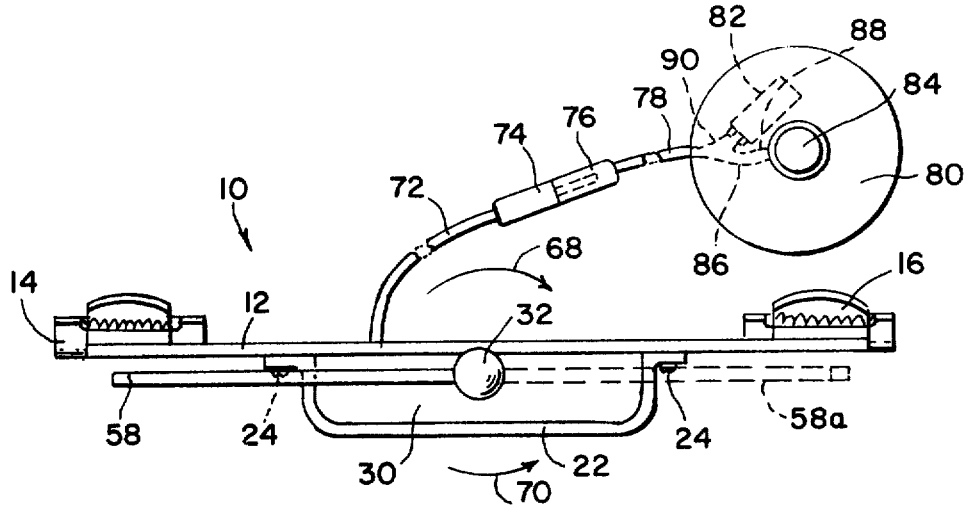
FIG. 2 is a side elevational view of the present invention.

FIG. 2 illustrates frame 12 carrying spring biased grasping devices 14 and 16. Housing 22 is shown disposed attached to frame 12 and having knob 32 located outwardly from side wall 30 thereof. Arm 58 is shown in the locked position. Dotted lines 58*a* illustrate the page turning arm in the released position after travelling in the direction of arrow 68. Manual manipulation of knob 32 in the direction of arrow 70 resets arm 58*a* from the released position shown into the locked position.

Wire 72 terminates at the terminals of solenoid coil 40, shown in FIG. 1. Plug 74 is shown electrically connected to jack 76 interconnecting wire 78 with wire 72. Housing 80, acting as a pedestal, houses battery 82 and monentary normally open pushbutton switch 84. Wires 86, 88, and 90 comprise a series electrical circuit including battery 82 and switch 84, and when used in combination with wires 78 and 72, electrically connect all the electrical components, including solenoid coil 40, shown in FIG. 1, in a series circuit. When switch 84 is momentarily closed, solenoid coil 40 is momentarily energized.

One of the advantages is to provide a page turning apparatus suitable for the manipulation of a single page.

Another advantage is to provide an inexpensive and lightweight page turning device.

Still another advantage is to provide a remotely operated page turning device which can be conveniently and readily secured to a book containing a page to be turned thereby.

Yet another advantage is to provide an apparatus which can be reset in preparation to turning subsequent pages by the simple turning of a knob.

Thus, there is disclosed in the above description and in the drawings, an embodiment of the invention which fully and effectively accomplishes the objects thereof. Howevers, it will become apparent to those skilled in the art, how to make variations and modifications to the instant invention. Therefore, this invention is to be limited, not by the specific disclosure herein, but only the the appending claims.

The embodiment of the invention in which an exclusive privilege or property is claimed are defined as follows:

1. A page turning apparatus comprising a page turning arm, a portion of said arm being disposed behind a page of an open book when said page turning arm is in a locked position, means to releasably engage said page turning arm in said locked position, said releasably engaging means including a shaft, a housing, said shaft being journalled to said housing, an arm, said arm extending radially outwardly from said shaft and disposed within said housing, a solenoid coil, said solenoid coil having a moving core portion, a portion of said moving core portion disposed outwardly from said solenoid coil and in touching engagement with the free end of said arm when said page turning arm is in said locked position, bias means to urge said page turning arm from said locked position into a released position, said portion of said page turning arm causing said page to be turned when said page turning arm traverses from said locked position to said released position, means to manually engage said page turning arm from said released position into said locked position.

2. The page turning apparatus as claimed in claim 1 wherein said manual engaging means comprises a knob, said knob fixedly secured to one end of said shaft, said one end of said shaft extending outwardly from said housing.

3. The page turning apparatus as claimed in claim 1 wherein said bias means comprises a helical spring, one end of said helical spring being fixedly secured to said housing, the other end of said helical spring in touching engagement with said arm, said spring urging said shaft to rotate about the longitudinal axis of said shaft and causing said free end of said arm to touch said portion of said moving core portion.

4. The page turning apparatus as claimed in claim 1 further comprising a battery, a momentary pushbutton switch said switch including normally open contacts the terminals of said switch and said battery and said solenoid coil being disposed in a series electrical circuit.

5. The page turning apparatus as claimed in claim 4 further comprising a plug, a jack, the terminals of said plug and said jack being disposed in said series electrical circuit between said terminals of solenoid coil and a portion of said series electrical circuit including said terminals of battery and said switch.

* * * * *